US006734399B2

(12) United States Patent
Asano et al.

(10) Patent No.: US 6,734,399 B2
(45) Date of Patent: May 11, 2004

(54) HEATER AND METHOD OF PRODUCING THE SAME

(75) Inventors: Takaaki Asano, Nagoya (JP); Hiroyuki Kimata, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 39 days.

(21) Appl. No.: 10/084,990

(22) Filed: Mar. 1, 2002

(65) Prior Publication Data

US 2002/0162834 A1 Nov. 7, 2002

(30) Foreign Application Priority Data

Mar. 2, 2001 (JP) ..... 2001-058724

(51) Int. Cl.[7] ..... F23Q 7/22
(52) U.S. Cl. ..... 219/270; 123/145 A
(58) Field of Search ..... 219/270, 544, 219/541; 123/145 A; 29/611; 313/318

(56) References Cited

U.S. PATENT DOCUMENTS 4,312,120 A * 1/1982 Comer ..... 29/611
4,563,568 A * 1/1986 Takizawa ..... 219/270
4,806,734 A * 2/1989 Masaka et al. ..... 219/270
4,810,853 A * 3/1989 Maruta et al. ..... 219/270
4,874,923 A * 10/1989 Hatanaka et al. ..... 219/270
4,912,305 A * 3/1990 Tatemasu et al. ..... 219/544
4,914,751 A * 4/1990 Masaka et al. ..... 219/270
5,206,484 A * 4/1993 Issartel ..... 219/270
5,218,183 A * 6/1993 Kimata ..... 219/270
5,767,485 A * 6/1998 Kumada ..... 219/270
6,013,898 A * 1/2000 Mizuno et al. ..... 219/270
6,049,065 A * 4/2000 Konishi ..... 219/270
6,276,325 B1 * 8/2001 Arlton ..... 123/145 A
6,437,492 B1 * 8/2002 Geissinger et al. ..... 313/118
2001/0017293 A1 * 8/2001 Nasu et al. ..... 219/270
2002/0175157 A1 * 11/2002 Terada et al. ..... 219/270
2002/0195443 A1 * 12/2002 Tanaka et al. ..... 219/541
2003/0029857 A1 * 2/2003 Taniguchi et al. ..... 219/270

* cited by examiner

*Primary Examiner*—Ehud Gartenberg
*Assistant Examiner*—Leonid M Fastovsky
(74) *Attorney, Agent, or Firm*—Sughrue Mion, PLLC

(57) ABSTRACT

A heater includes a metallic shell, a heating element disposed at an end of the metallic shell, and a terminal electrode electrically connected to the heating element. The terminal electrode has a protruded portion protruding from the metallic shell. The protruded portion has a locking engagement section lockingly engageable with a connector for electrically connecting the terminal electrode to an outside for conduction of the heating element. A method of producing such a heater is also provided.

24 Claims, 9 Drawing Sheets

HEATER AND METHOD OF PRODUCING THE SAME

BACKGROUND OF THE INVENTION

The present invention relates in general to heaters such as a ceramic heater and sheath heater and more specifically to a heater such as a glow plug for assisting start of a diesel engine and a water heater for heating coolant of an engine. The present invention further relates to a method of producing such a heater.

Heretofore, for the purpose of quickly starting a diesel engine, glow plugs have been installed on a cylinder block for pre-heating air within respective combustion chambers.

A conventional glow plug of the above-described kind is shown in FIG. 10. The glow plug includes a rod-shaped ceramic heater P4 having a sintered ceramic body P3 in which lead wires P1 and heating element P2 are embedded.

On the ceramic heater P4 is fitted a metallic tube P5 on which is fitted a metallic shell P6 which is to be fixed to a cylinder block. To the rear end (upper end in FIG. 10) of the metallic shell P6 are attached an insulator P7 and a round nut P13. Inside the metallic shell P6 are disposed a spring-shaped external connecting wire P8 connected to the ceramic heater P4 and a rod-shaped terminal electrode P9 connected to the external connecting wire P8.

The terminal electrode P9 has a protruded rear end portion protruding from the metallic shell P6 and having a threaded section P10 onto which is screwed a nut P11. The nut P11 cooperates with the insulator P7 to interpose therebetween a power supply metallic member P12 in the form of an elongated plate and hold it tightly therebetween. By applying a voltage across the power supply metallic member P12 and the metallic shell P6 (by way of the cylinder block), the ceramic heater P4 is caused to conduct and generate heat.

Cylinders of the diesel engine are provided with such glow plugs, and the power supply metallic member P12 is disposed so as to interconnect the protruded rear end portions of the terminal electrodes P9.

SUMMARY OF THE INVENTION

In these days, in order to prevent the exhaust gas emission of the engine from becoming worse, it is required to check the deterioration in performance of the glow plugs. However, the conventional glow plugs cannot suitably meet the requirement due to its structure.

For example, if the performance of each glow plug can be checked by OBD (On-Board Diagnosis) by using a test terminal connected to a microcomputer, the glow plug can be checked with ease. However, heretofore, the single power supply metallic member P12 has been used for supply of power to the glow plugs, so that it has been impossible to check the performance of each glow plug with ease.

Namely, in order to check the performance of each glow plug, it has been required to remove the power supply metallic member P12 and bring the terminal electrode P9 of each glow plug into contact with the test terminal, resulting in the necessity of a difficult work.

It is accordingly an object of the present invention, to provide a heater adapted to be able to check its performance with ease, i.e., by on-board diagnosis.

It is another object of the present invention to provide a heater and connector assembly which enables a heater to be checked by on-board diagnosis.

It is a further object of the present invention to provide a method of producing a heater of the foregoing character.

According to an aspect of the present invention, there is provided a heater comprising a metallic shell, a heating element disposed at an end of the metallic shell, and a terminal electrode partially disposed within the metallic shell and electrically connected to the heating element, wherein the terminal electrode has a protruded portion protruding from the metallic shell, and the protruded portion of the terminal electrode has a locking engagement section lockingly engageable with a connector for electrically connecting the terminal electrode to an outside for conduction of the heating element.

According to another aspect of the present invention, there is provided a heater and connector assembly comprising a heater having a metallic shell, a heating element disposed at a front end of the metallic shell, and a terminal electrode partially disposed within the metallic shell and electrically connected to the heating element, the terminal electrode having a protruded portion protruding from the metallic shell, the protruded portion of the terminal electrode having a locking engagement section, and a connector for electrically connecting the terminal electrode to an outside for conduction of the heating element, the connector being hollow and having a locking engagement section that is lockingly engaged with the locking engagement section of the terminal electrode thereby preventing axial movement of the connector relative to the terminal electrode.

According to a further aspect of the present invention, there is provided a method of producing a heater having a metallic shell, a heating element and a rod-shaped terminal electrode for electrically connecting the heating element to an outside for conduction of the heating element, comprising the steps of preparing an inner pole member and a terminal member which have joining portions one of which is hollow so that the other of the joining portions can be fitted in said one of the joining portions, fitting the other of the joining portions in said one of the joining portions, caulking the joining portions thereby joining the inner pole member and the terminal member together to constitute the terminal electrode, and disposing the terminal electrode in place within the metallic shell.

DESCRIPTION OF THE PREFERRED EMBODIMENTS (First embodiment)

A heater according to a first embodiment is a ceramic glow plug for assisting start of a diesel engine.

(a) Firstly, the structure of a glow plug of this embodiment will be described with reference to FIG. 1.

Figure 1:
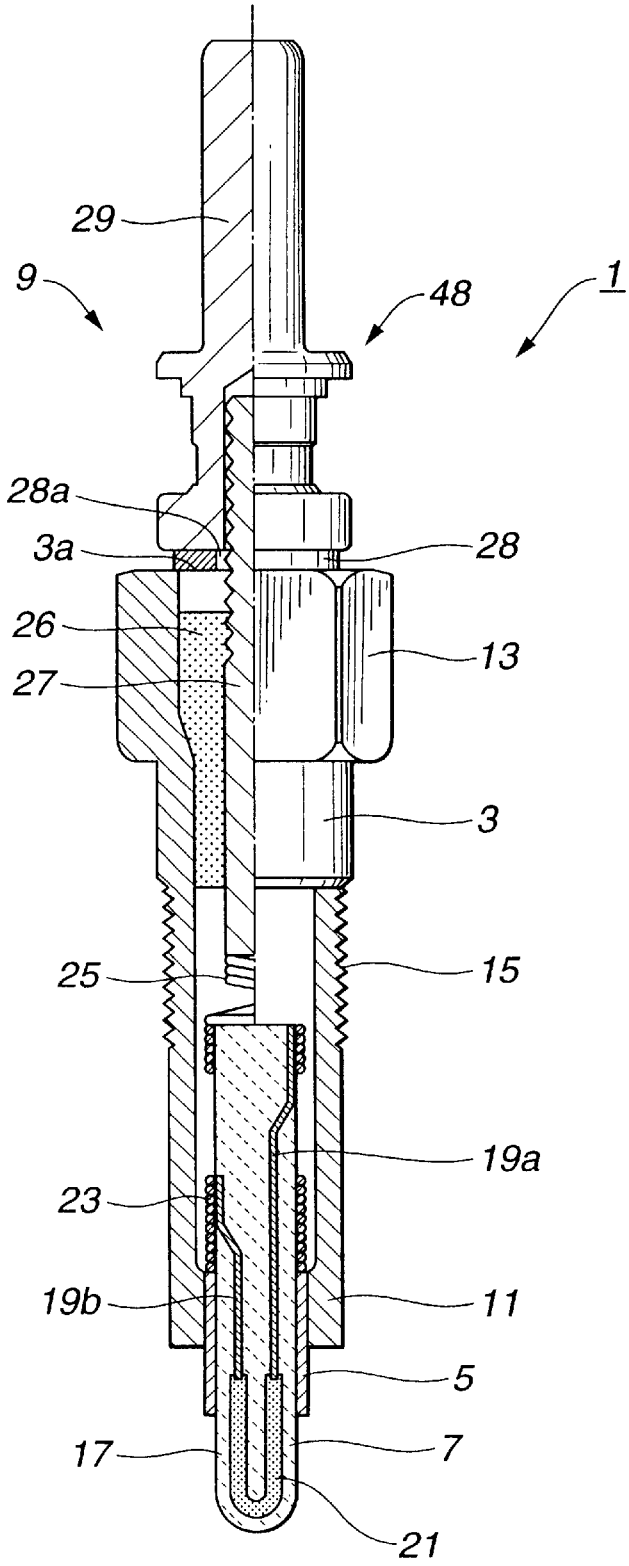
FIG. 1 is a partially sectional, schematic elevation of a glow plug according to a first embodiment of the present invention.

As shown in FIG. 1, the glow plug is generally indicated by 1 and includes a cylindrical metallic shell 3, a cylindrical metallic sleeve 5 fitted in a front end portion of the metallic shell 3, a ceramic heating element (heat generating section) 7 fitted in the metallic sleeve 5 and a terminal electrode 9 fitted in the metallic shell 3 and insulated therefrom.

The metallic shell 3 is made of carbon steel and has at a front end thereof a radially inwardly projecting holder portion 11. Further, the metallic shell 3 has at a rear end thereof a hexagonal portion 13 for engagement with a socket of a wrench (not shown) and at a place intermediate between the front and rear ends thereof a threaded portion 15 for screwing the glow plug 1 to a cylinder head of a diesel engine (not shown).

The metallic sleeve 5 is made of a heat-resistant metal and brazed at a rear end portion thereof to the holder portion 11 of the metallic shell 3.

The ceramic heating element 7 has a ceramic body 17 containing $Si_3N_4$ as a major constituent. Within the ceramic body 17 are embedded a pair of lead wires 19*a* and 19*b* and a U-shaped heating resistor 21 containing WC as a major constituent.

The lead wire 19*b* is electrically connected to the metallic shell 3 by way of an external connecting wire 23 in the form of a coil spring and the metallic sleeve 5. The other lead wire 19*a* is electrically connected to the terminal electrode 9 by way of an external connecting wire 25 in the form of a coil spring.

The terminal electrode 9 is rod-shaped and disposed coaxial with the metallic shell 3. As will be described in detail hereinafter, the terminal electrode 9 has a front end portion which is disposed within the metallic shell 3 and fixedly attached to same by a glass seal 26. A rear end portion of the terminal electrode 9 is adapted to protrude largely from the rear end of the metallic shell 3.

On the rear end surface 3*a* of the metallic shell 3 is disposed a ring-shaped insulator 28 made of Bakelite (trademark). The insulator 28 has at the center thereof an opening 28*a* through which the terminal electrode 9 extends. By the insulator 28, the metallic shell 3 and the terminal electrode 9 are insulated from each other.

(b) Referring to FIG. 2, the terminal electrode 9 which is an important portion of the glow plug 1 of this embodiment will be described.

Figure 2:
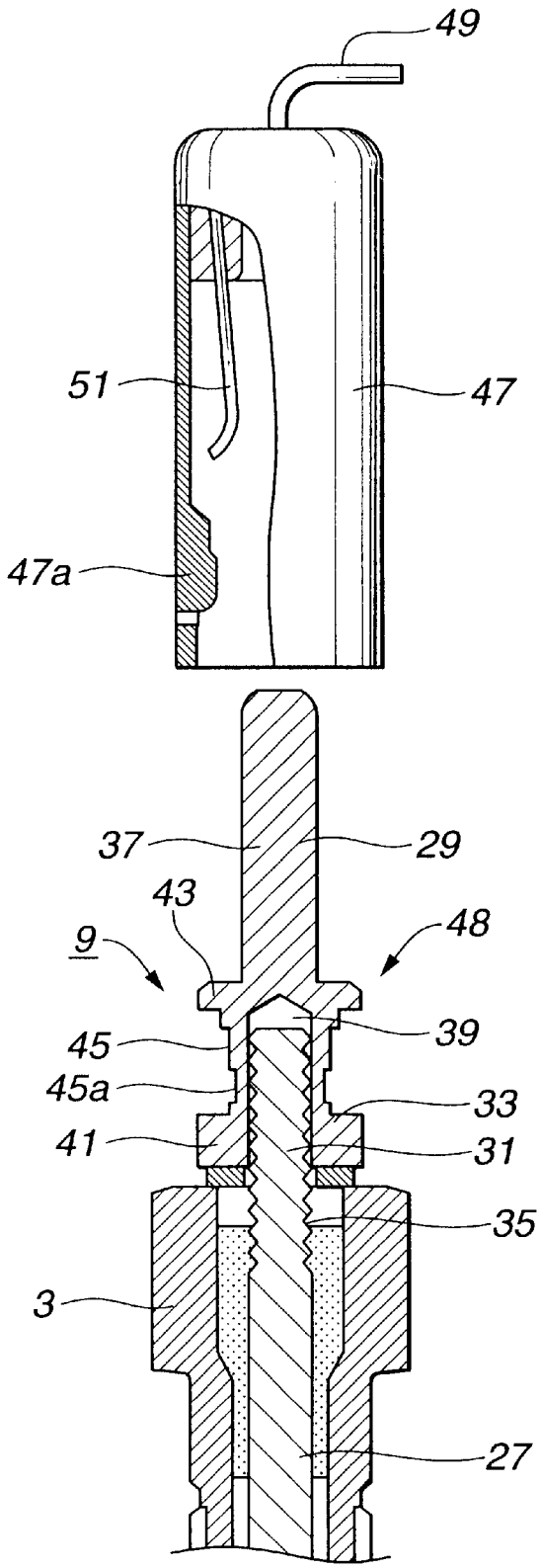
FIG. 2 is a partially sectional, schematic elevation of a rear end portion of the glow plug of FIG. 1 and a connector to be attached thereto.

(1) As shown in FIG. 2, the terminal electrode 9 is made up of an inner pole member 27 made of stainless steel and a terminal member 29 made of steel. The inner pole member 27 and terminal member 29 have joining portions 31 and 33 at which they are joined together by caulking so as to constitute an integral unit.

The inner pole member 27 is in the form of a round straight bar, i.e., rod-shaped and 50 mm long and 3.5 mm in diameter. The inner pole member 27 is brought into contact at the front end thereof with the external connecting wire 25 (refer to FIG. 1) and has a threaded rear end portion 35 that serves as the joining portion 31.

The terminal member 29 has at the front side thereof the joining portion 33 and at the rear side thereof a rod-shaped connecting portion 37. The joining portion 33 is hollow and cup-shaped so as to have an open lower end when observed in the drawing. Namely, the joining portion 33 has a depression 39 for receiving therewithin the joining portion 31 of the inner pole member 27. The depression 39 has a knurled inner circumferential surface.

Further, the terminal member 29 has at a front end thereof a first flange 41 of 9 mm in outer diameter and a second flange 43 of 8.5 mm in outer diameter. The second flange 43 is spaced rearward from the first flange 41 by 4 mm. Between the flanges 41 and 43, the terminal member 29 is formed with a depressed circumferential portion 45. The first flange 41 and the depressed circumferential portion 45 constitute a locking or snapping engagement section 48 that is lockingly or snappingly engageable with a connector 47 which will be described hereinafter.

In this embodiment, by inserting the joining portion 31 into the depression 39 of the joining portion 33 and subjecting the depressed circumferential portion 45 to caulking, e.g., 4-point caulking, the joining portions 31 and 33 are firmly joined together thereby allowing the inner pole member 27 and terminal member 29 to constitute an integral unit.

In the meantime, the depressed circumferential portion 45 has depressions 45*a* that are formed by caulking.

(2) The terminal electrode 9 is adapted to be covered by the connector 47 that is a cup-shaped conductive member for supplying power (e.g., from a battery) to the glow plug 1. The connector 47 is mounted onto the terminal electrode 9 from the rear end side of the terminal member 29.

Namely, when the connector 47 is mounted on the terminal member 29 of the terminal electrode 9, the locking engagement section 47*a* is lockingly engaged in the depressed circumferential portion 45 of the joining portion 33 of the terminal member 29 and thereby lockingly engaged with the locking engagement section 48. By this, the connector 47 is lockingly engaged with the terminal member 29 so as to prevent axial movement thereof relative to the terminal electrode 9. Simultaneously with this, a conductive plate 51 of the connector 47, that is disposed within the connector 47 and electrically connected to a lead wire 49, is brought into contact with the rod-shaped connecting portion 37 of the terminal member 29 to electrically connect the terminal electrode 9 to the lead wire 49.

(c) Referring to FIG. 3, the electrical structure and the operation of the glow plug 1 of this embodiment will be described.

Figure 3:
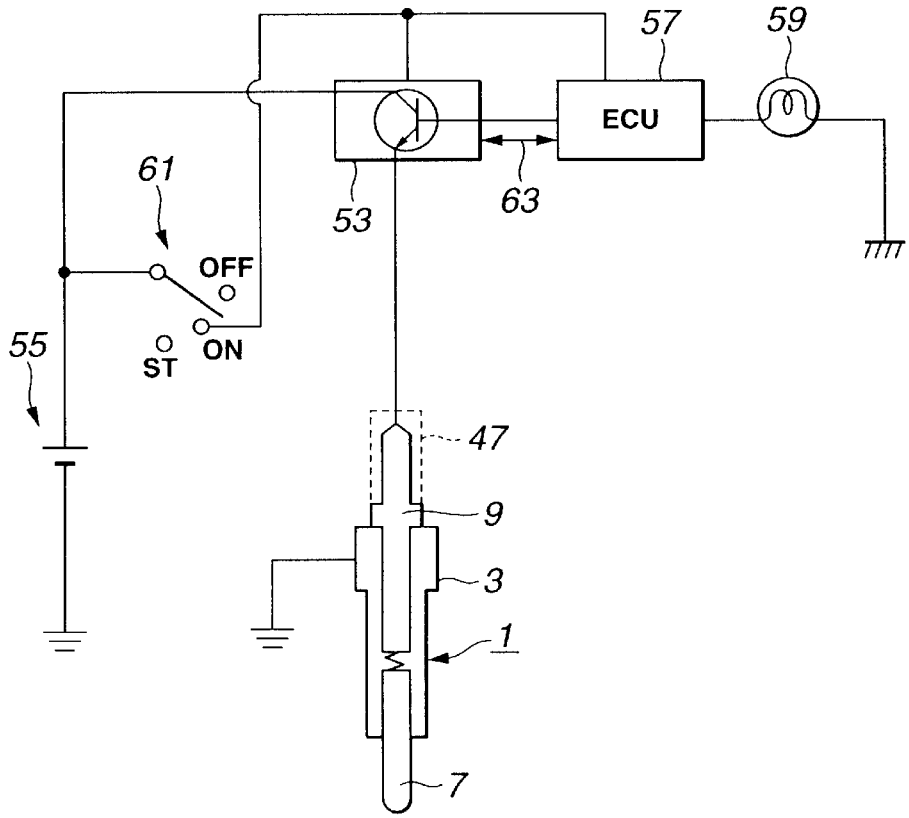
FIG. 3 is a circuit diagram for use with the glow plug of FIG. 1.

(1) As shown in FIG. 3, when the glow plug 1 is installed on a diesel engine, the metallic shell 3 is brought into contact with a cylinder block (not shown) to serve as a grounding electrode.

When the connector 47 is attached to the terminal electrode 9, the terminal electrode 9 is electrically connected to a battery (or electric motor) 55 by way of a glow controller 53 that controls supply of electric power to the glow plug 1 and to a glow lamp 59 by way of the glow controller 53 and an electronic control unit (ECU) having a microcomputer as a major component. Further, a key switch 61 can be turned to ST (start), ON and OFF selectively. The glow controller 53 and ECU 57 are selectively connected to or disconnected from the battery 55 by the operation of the key switch 61.

Accordingly, when electric power is supplied from the battery 55 to the glow plug 1, the ceramic heating element 7 generates heat and thus can heat the associated combustion chamber of the diesel engine.

(2) Further, in this embodiment, in order to check the performance of the glow plug 1 under an on-board condition (i. e., under a condition where the glow plug 1 is not removed from the diesel engine but mounted on same), the glow controller 53 and the ECU 57 are connected to each other by a signal line 63.

Accordingly, by applying voltage for diagnosis from, for example, the ECU 57 to glow plug 1 and detecting the resulting current through the glow plug 1 (i.e., by performing on-board diagnosis), the performance of the glow plug 1 can be checked automatically. Namely, this embodiment makes it possible to check the performance of the glow plug 1 by on-board diagnosis.

(d) Then, the method of producing the glow plug 1 of this embodiment will be described.

(1) Production of the ceramic heating element 7

First, a material for the heating resistor 21 is prepared. The material contains 60 parts by weight of WC and 40 parts by weight of insulating ceramic.

Then, a dispersing agent and a solvent are added to the material, and the resulting mixture is pulverized and dried. An organic binder is added to the pulverized mixture thereby obtaining a granular material.

Within a mold (not shown) having a U-shaped cavity are disposed end portions of the silver-coated lead wires 19*a* and 19*b*. The granular material is injected into the U-shaped cavity of the mold thereby forming a U-shaped green heating resistor 41 joined with the end portions of the lead wires 19*a* and 19*b*.

Then, a ceramic powder is prepared. A material for the ceramic powder contains an insulating ceramic containing 89 parts by weight of $Si_3N_4$, 10 parts by weight of $Er_2O_3$ and 1 part by weight of $SiO_2$.

To $Er_2O_3$ and $SiO_2$ of those components is first added a dispersing agent, and the mixture is pulverized and dried. Then, $Si_3N_4$ is added to the mixture, and the mixture is pulverized again. Thereafter, a binder is added to the mixture to produce a granular material.

Then, a pair of pressed bodies in the form of halves of a rod which is divided by a plane including a center axis thereof is formed from the granular material. Between the pressed bodies is disposed the heating resistor 41, and the pressed bodies are joined together to form a rod-shaped assembly.

Then, the assembly is set in a carbon mold and hot-pressed at 1,750° C. in an $N_2$ gas atmosphere and under pressure of 200 $Kg/cm^2$ thereby forming a ceramic sintered body in the form of a nearly round bar with a semispherical front end.

The ceramic sintered body is finished by grinding so as to have a predetermined size, while allowing the lead wires 19*a* and 19*b* to be exposed to the outside of the ceramic sintered body. The ceramic heating element 7 is thus completed.

(2) Production of the inner pole member 27 and the terminal member 29

Independent from the above-described fabrication, the inner pole member 27 and terminal member 29 are produced.

Specifically, the inner pole member 27 and terminal member 29 are formed from respective rod-shaped materials by grinding.

The inner pole member 27 is threaded so as to have a threaded rear end portion 35. The inner circumferential surface of the depression 39 of the terminal member 29 is knurled so as to have a series of small ridges arranged in a network.

(3) Assembly of the ceramic heating element 7, external lead wires 25, 23, and metallic sleeve 5

A glass layer is formed on the ceramic heating element 7 by baking, i.e., on a surface portion to be held by the metallic sleeve 5 and on circumferential portions to be connected with the external connecting wires 23 and 25 (except for the portion to be electrically connected).

The lead wires 19*a* and 19*b* of the ceramic heating element 7 are electrically connected to the external connecting wires 25 and 23 by brazing, respectively. Simultaneously with this, the external connecting wire 19*b* is electrically connected to the rear end of the metallic sleeve 5 mounted on the ceramic heating element 7 by brazing. The assembly of the ceramic heating element 7, external connecting wires 23, 25 and metallic sleeve 5 is thus completed.

The assembly of the ceramic heating element 7, external connecting wires 23, 25 and metallic sleeve 5 is inserted into the metallic shell 3, after the inner pole member 27 is connected to the external connecting wire 25, and the rear end outer circumferential portion of the metallic sleeve 5 is brazed to the inner circumferential surface of the holding portion 11.

(4) Assembly of the glow plug 1

The assembly of the ceramic heating element 7, external connecting wires 23, 25 and metallic sleeve 5 is inserted into the metallic shell 3 from the rear end side of the metallic shell 3 and through the insulator 28, and a mass of glass is disposed around the inner pole member 27.

The mass of glass is heated and cooled so as to form the glass seal 26. By the glass seal 26, the inner pole member 27 is fixed to the metallic shell 3 (i.e., the assembly of the ceramic heating element 7 is fixed).

(5) Connection of the inner pole member 27 and terminal member 29

First, into the depression 39 of the joining portion 33 of the terminal member 29 is inserted the joining portion 31 of the inner pole member 27. Since the depression 39 has an extra depth for allowing adjustment of the position of the joining portion 31 with respect to the joining portion 33, the position of the inner pole member 27 with respect to the terminal member 29 is adjustable and can be determined so that the terminal electrode 9 has a predetermined overall length.

Figures 4A, 4B, 4C, 4D:
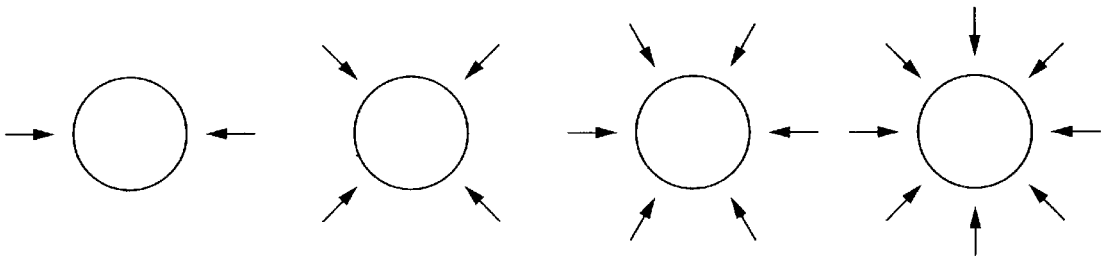
FIGS. 4A to 4D are illustrations showing various types of caulking for the glow plug of FIG. 1.

Under the thus assembled condition, the depressed circumferential portion 45 of the terminal member 29 is caulked by using a caulking device for, e.g., 4-point caulking as shown in FIG. 4B, namely, by pressing the circumferential periphery of the terminal member 29 radially inward at four points (with intervals of 90 degrees).

By this, the inner pole member 27 and the terminal member 29 are firmly connected together to constitute an integral unit thereby completing the glow plug 1.

(e) Since the inner pole member 27 and the terminal member 29 which are joined together by caulking in the above-described manner, the terminal electrode 9 in this embodiment can have a sufficient strength.

Further, by producing the terminal electrode 9 in the above-described manner, the manufacturing cost can be reduced and the dimensional accuracy can be improved as compared with those of a terminal electrode that is formed from a single rod by grinding.

Further, since the inner circumferential surface of the depression 39 of the terminal member 29 is knurled and the outer circumferential surface of the joining portion 31 of the inner pole member 27 is threaded in this embodiment, the terminal electrode 9 has an advantage in that the connection of the inner pole member 27 and the terminal member 29 is hard to become loose even when subjected to a relatively large impact or over a long period of usage.

In the meantime, differing from the above, the both mating surfaces of the joining portions 31 and 33 can be knurled or threaded. Further, only one of the mating surfaces can be knurled or threaded to dispense with such a surface machining for the other of the mating surfaces.

Further, since the depression 39 of the terminal member 29 has an extra depth, a predetermined overall length of the terminal electrode 9 can be attained assuredly through adjustment of the position of the inner pole member 27 that is inserted into the depression 39, with respect to the terminal member 29, notwithstanding of variations of dimensional accuracies of the inner pole member 27 and terminal member 29.

From the foregoing, it will be understood that since conduction of each glow plug 1 can be attained independently by attaching the connector 47 to the terminal member 29, it becomes possible to check the performance of each glow plug 1 by on-board diagnosis by ECU 63.

Further, the connector 47 can be lockingly engaged with the terminal member 29 when simply put on the terminal member 29 due to the locking engagement section 48, this embodiment has an advantage in that attachment of the connector 47 to the terminal electrode 9 can be attained with ease and assuredness.

(f) Description will be made as to the test for confirming the effect of the glow plug 1 and the effect of the production method thereof according to this embodiment.

In the test, various examples are produced in which the caulking shape or structure and the clearance between the joining portions 31 and 33 of the inner pole member 27 and terminal member 29 are varied, and the tensile strength of each example is measured before and after an impact test. The result of test is shown in Tables 1 and 2.

In the meantime, the tensile test was conducted by using Autograph AG-5000B manufactured by Shimazu Mfg. K.K.

Further, the impact test was conducted by using an apparatus for testing the durability and impact properties according to JISB8031, and by applying an impact with an impact stroke of 5 mm.

As will be apparent from Tables 1 and 2, the inner pole member 27 and the terminal member 29 can be joined firmly by caulking. Particularly, 4-point caulking is desirable since the assembly of the inner pole member 27 and terminal member 29, i.e., the terminal electrode 9 can have a large strength against impact. Further, when the clearance between the inner pole member 27 and terminal member 29 is 0.1 mm or less, the terminal electrode 9 can have a large strength against impact.

In the meantime, the joining strength of the inner pole member 27 and terminal member 29 (corresponding to the tensile strength of the terminal electrode 9) is preferably 1500N or higher, and more preferably 2000N or higher.

TABLE 1

| Caulking Shape | Clearance Between Inner Pole Member And Terminal Member [mm] | | Tensile Strength Before Impact Test [N] | Tensile Strength After Impact Test [N] | Remarks |
|---|---|---|---|---|---|
| 2-point Caulking | 0.15 | | 970 | 0 | |
| | | | 1100 | 0 | |
| | | | 1010 | 0 | |
| | | | 920 | 0 | |
| | | | 720 | 0 | |
| | | Average | 944 | 0 | |
| | | Disperse σ | 142 | 0 | |

TABLE 1-continued

| Caulking Shape | Clearance Between Inner Pole Member And Terminal Member [mm] | | Tensile Strength Before Impact Test [N] | Tensile Strength After Impact Test [N] | Remarks |
|---|---|---|---|---|---|
| 4-point Caulking | 0.15 | | 2160 | 1900 | Removal of terminal member was not caused after impact test |
| | | | 2250 | 1760 | |
| | | | 2020 | 1610 | |
| | | | 2320 | 1430 | |
| | | | 1990 | 1530 | |
| | | Average | 2148 | 1646 | |
| | | Disperse σ | 143 | 186 | |
| 6-point Caulking | 0.15 | | 2440 | 2440 | Decrease in strength was scarcely caused after impact test |
| | | | 2610 | 2300 | |
| | | | 2820 | 2540 | |
| | | | 2670 | 2760 | |
| | | | 2750 | 2390 | |
| | | Average | 2658 | 2486 | |
| | | Disperse σ | 145 | 176 | |

TABLE 2

| Caulking Shape | Clearance Between Inner Pole Member And Terminal Member [mm] | | Tensile Strength Before Impact Test [N] | Tensile Strength After Impact Test [N] | Remarks |
|---|---|---|---|---|---|
| 4-point Caulking | 0.1 | | 2590 | 2530 | Decrease in strength was not caused after impact test |
| | | | 2470 | 2420 | |
| | | | 2320 | 2380 | |
| | | | 2550 | 2550 | |
| | | | 2580 | 2680 | |
| | | Average | 2502 | 2512 | |
| | | Disperse σ | 112 | 118 | |

(Second Embodiment)

Figure 5:
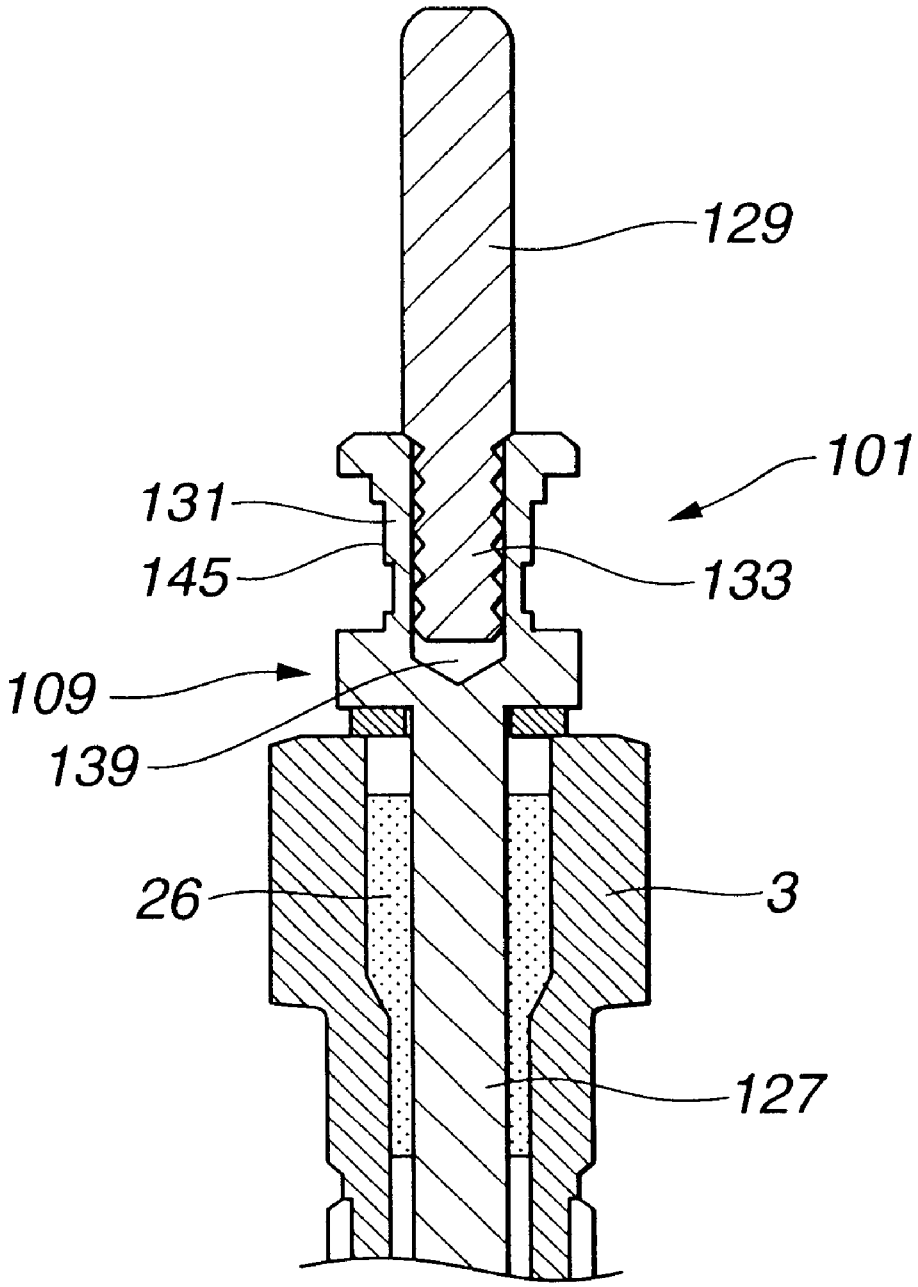
FIG. 5 is a schematic sectional view of a rear end portion of a glow plug according to a second embodiment.

Referring to FIG. 5, a glow plug 101 according to the second embodiment will be described. In FIG. 5, like parts to those of the first embodiment will be designated by like reference characters and will not be described again.

This embodiment differs from the first embodiment in that a terminal electrode 109 is made up of an inner pole member 127 and a terminal member 129. The inner pole member 127 has at a rear end portion thereof a cup-shaped joining portion 131 having a depression 139. The terminal member 129 has at a front end portion thereof a threaded joining portion 133 which is inserted into the depression 139. The joining portion 131 has a depressed circumferential portion 145 at which it is subjected to caulking. By this, the inner pole member 127 and terminal member 129 are firmly joined together to constitute an integral unit.

By this embodiment, the terminal member 129 can be smaller in size as compared with the first embodiment and is therefore harder to be removed from the inner pole member 127.

Except for the above, this embodiment can produce substantially the same effect as the first embodiment.

(Third Embodiment)

Figure 6:
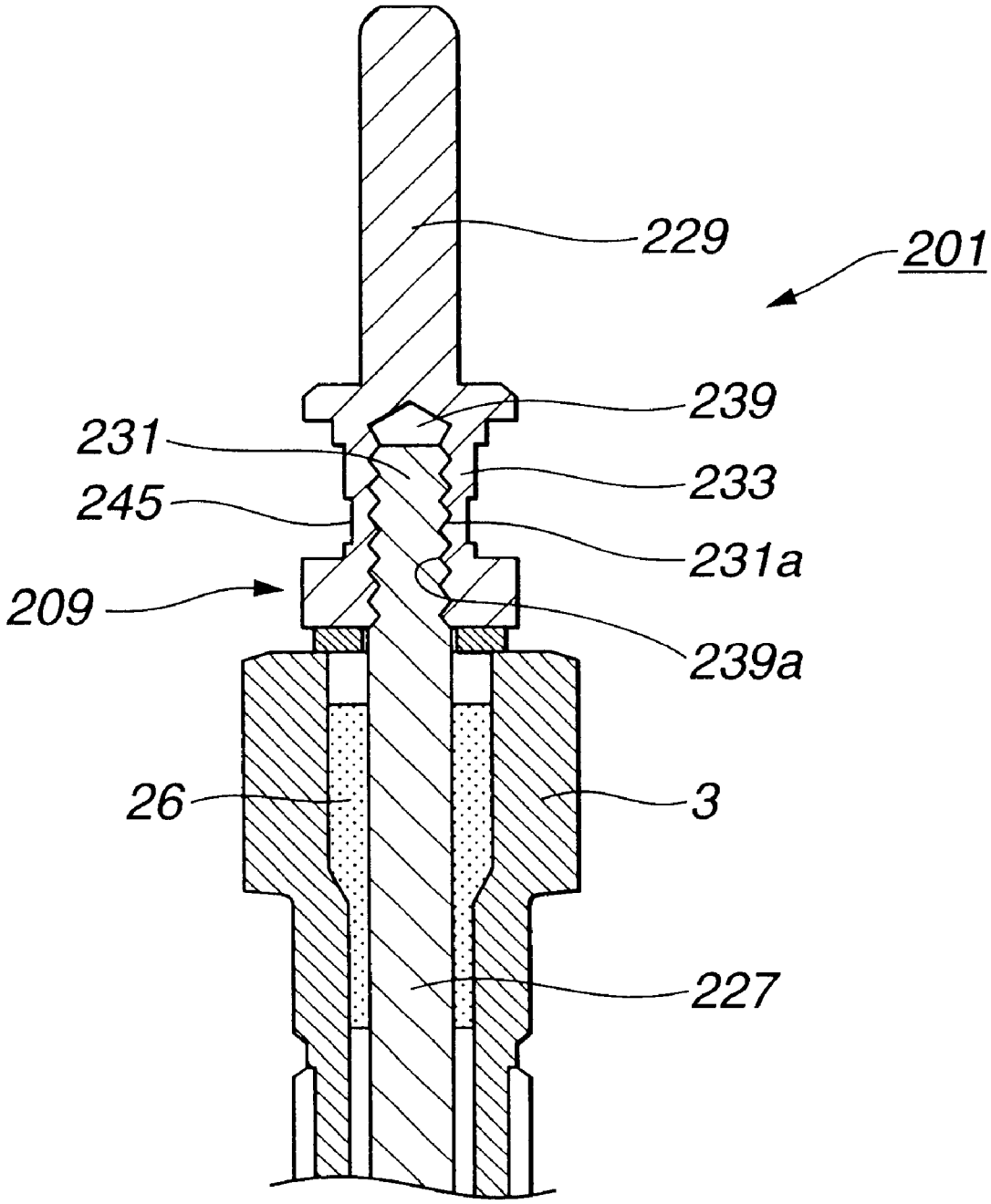
FIGS. 6 to 8 are views similar to FIG. 5 but shows third to fifth embodiments.

Referring to FIG. 6, a glow plug 201 according to the third embodiment will be described. In FIG. 6, like parts to those of the first embodiment will be designated by like reference characters and will no be described again.

This embodiment differs from the first embodiment in that a cup-shaped joining portion 233 of a terminal member 239 has a depression 239 having a threaded inner circumferential surface 239*a* and a joining portion 231 of an inner pole member 227, that is inserted into the joining portion 233, has a threaded outer circumferential surface 231*a*. Thus, the inner pole member 227 and terminal member 229 are firmly joined together to constitute a terminal electrode 209 by screwing the joining portion 231 into the joining portion 233 and pressing radially inward and thereby caulking a depressed circumferential portion 245 of the joining portion 233.

This embodiment has an advantage in that since the inner pole member 227 and terminal member 229 are joined together through engagement of the threaded surfaces 231*a* and 239*a* thereof, the terminal member 229 is quite hard to be removed from the inner pole member 227. Except for the above, this embodiment is substantially the same as the first embodiment and can produce substantially the same effect.

(Fourth Embodiment)

Figure 7:
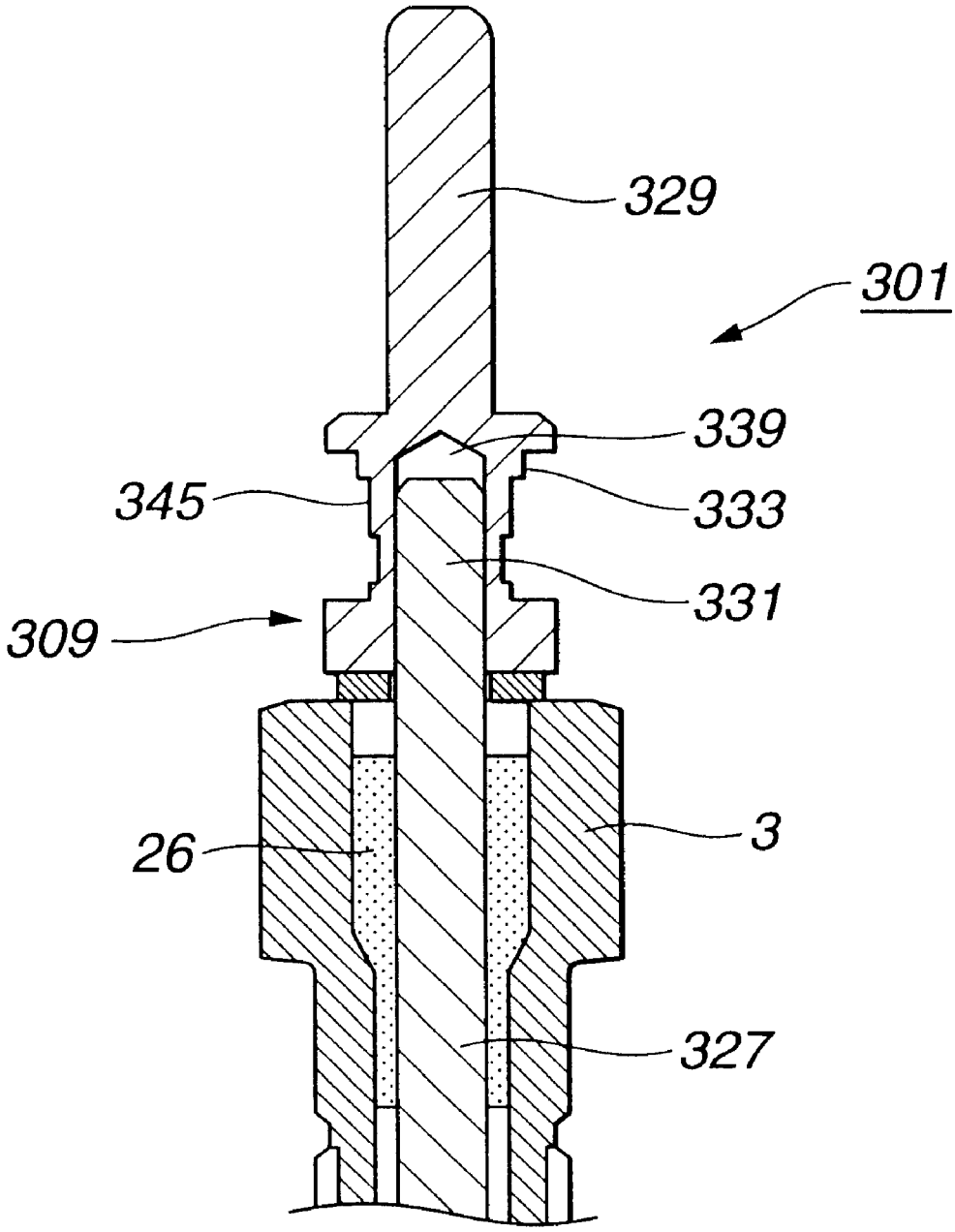

Referring to FIG. 7, a glow plug according to the fourth embodiment will be described. In FIG. 7, like parts to those of the first embodiment will be designated by like reference characters and will no be described again.

This embodiment differs from the first embodiment in that a joining portion 331 of an inner pole member 327 is not threaded and joined to a cup-shaped joining portion 333 of a terminal member 329 by using a conductive adhesive. Namely, to an inner circumferential wall of a depression 339 and an outer circumferential surface of the joining portion 331 is applied a conductive adhesive to which is added a filler such as silver, nickel and carbon.

The inner pole member 327 and the terminal member 329 are joined together to constitute an integral unit, i.e., a terminal electrode 309 by being fitted together as described above and pressing radially inward thereby caulking a depressed circumferential portion 345.

An advantage of this embodiment is that the work for knurling or threading can be dispensed with and therefore the work for joining the inner pole member 327 and the terminal member 329 can be simplified. However, the joining surfaces of the inner pole member 227 and the terminal member 329 may be knurled or threaded in order to make higher the joining strength.

Except for the above, this embodiment is substantially similar to the first embodiment and can produce substantially the same effect.

(Fifth Embodiment)

Figure 8:
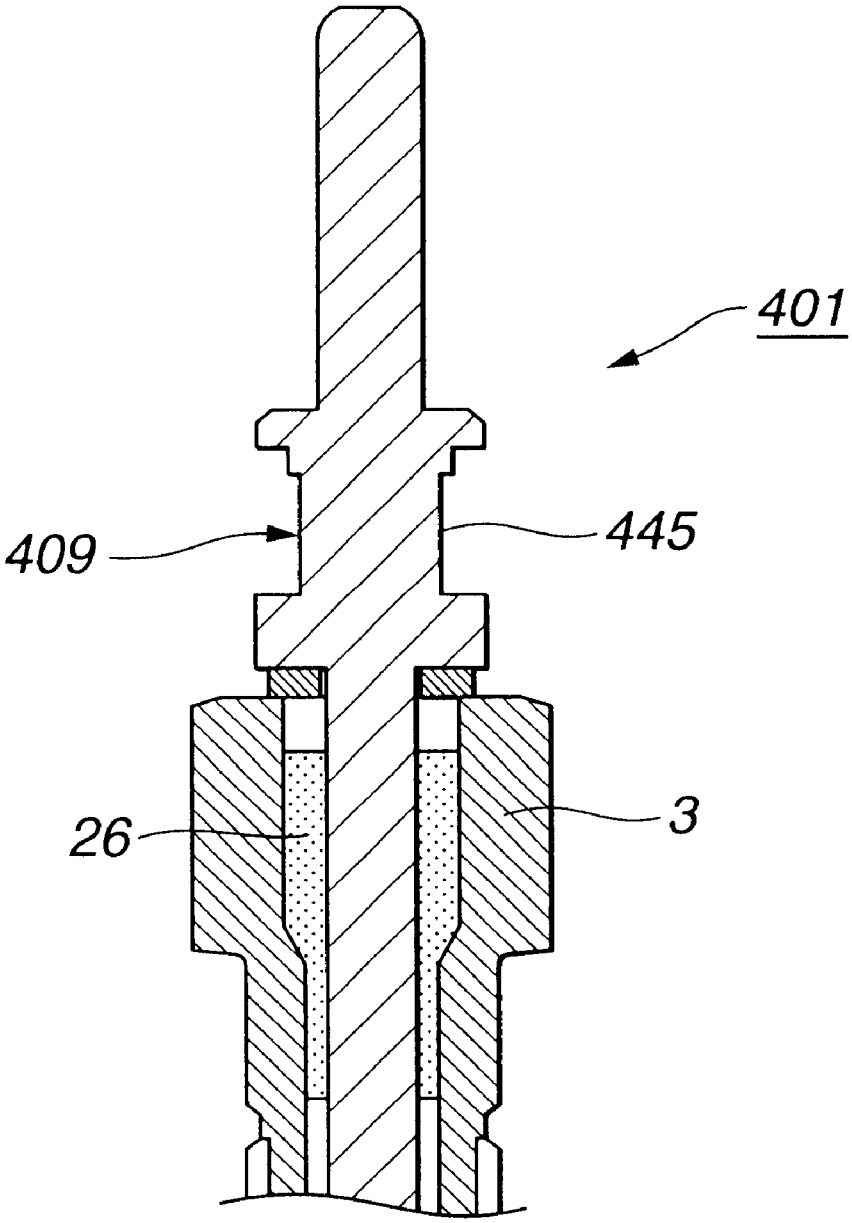

Referring to FIG. 8, a glow plug 401 according to the fifth embodiment will be described. In FIG. 8, like parts to those of the first embodiment will be designated by like reference characters and will no be described again.

This embodiment differs from the first embodiment in that a terminal electrode 409 is a single piece and formed from a single rod by machining and a depressed circumferential surface 445 does not have depressions due to caulking.

Except for the above, this embodiment is substantially similar to the first embodiment and can produce substantially the same effect.

(Sixth Embodiment)

Figure 9:
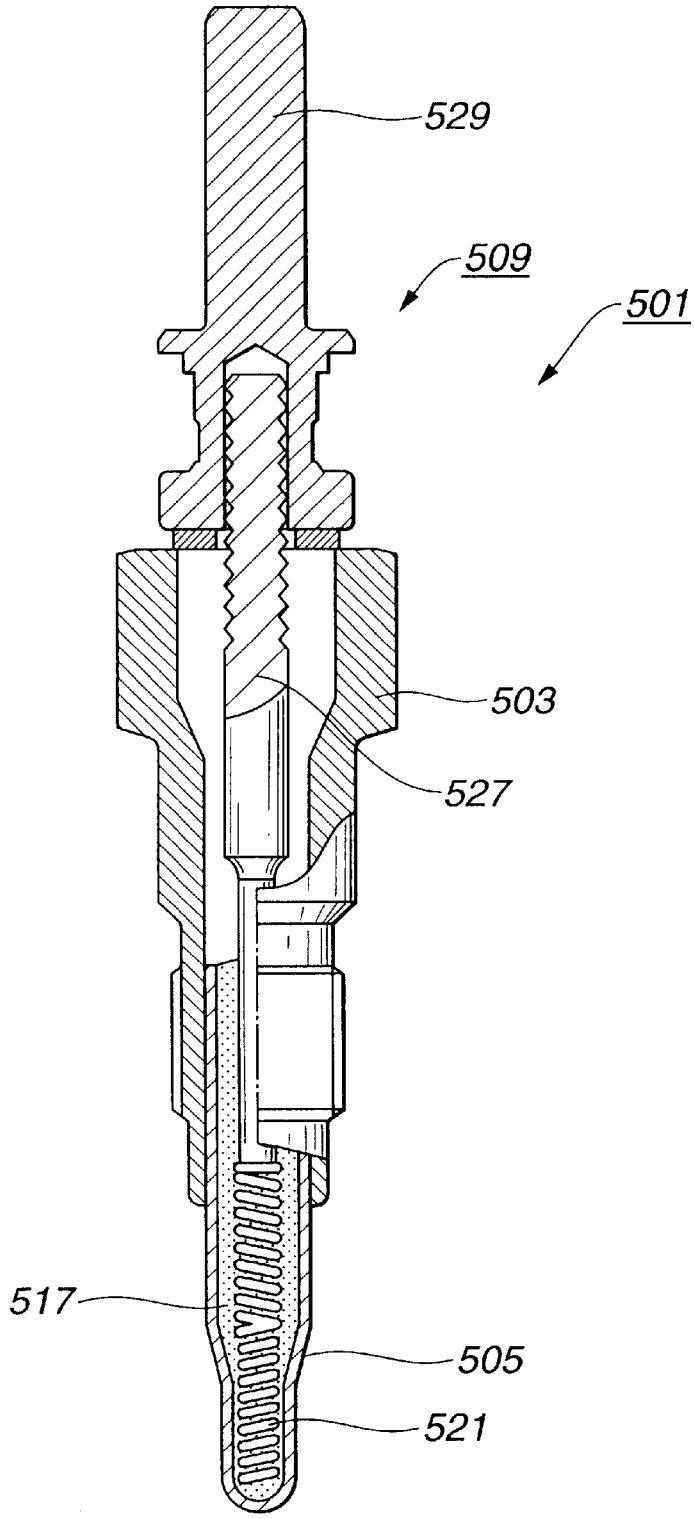
FIG. 9 is a partially sectional, schematic elevation of a sheath heater according to a sixth embodiment.
Figure 10:
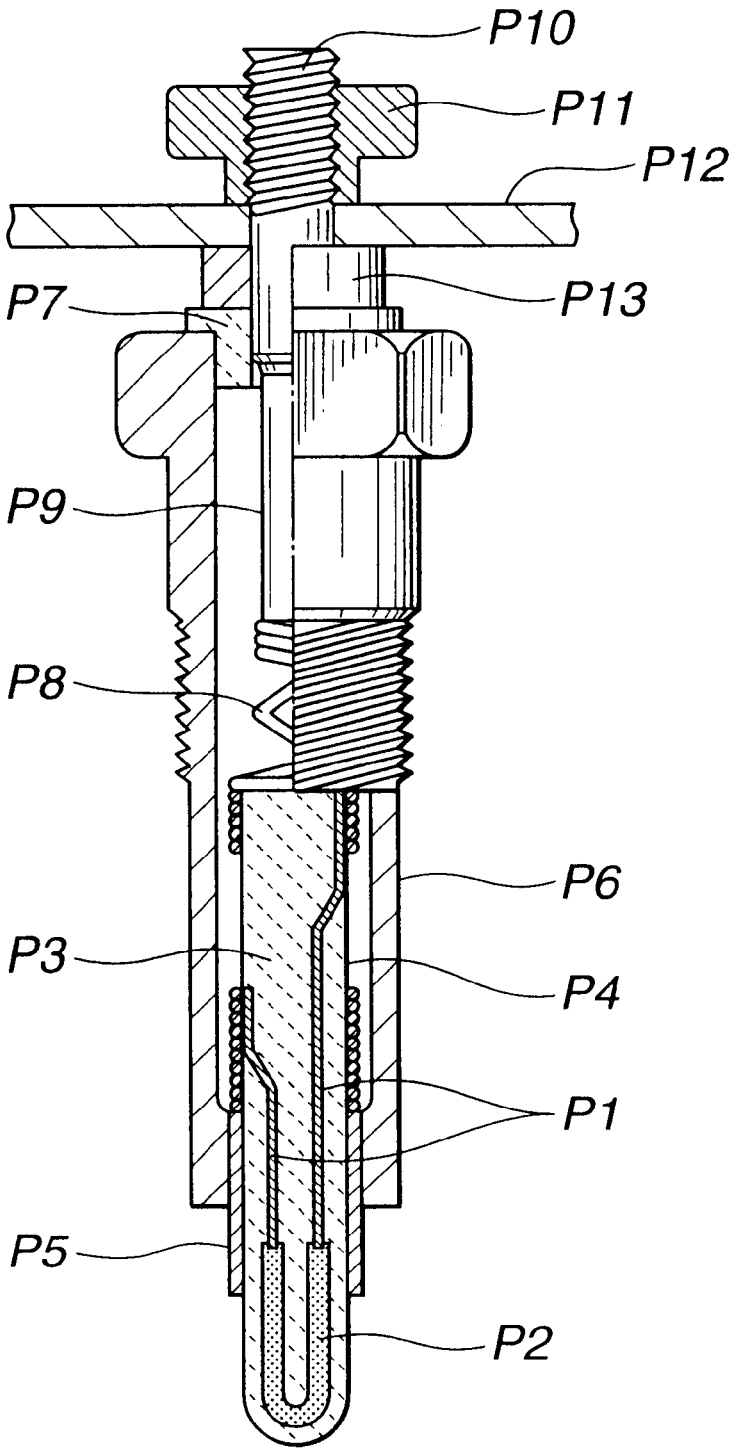
FIG. 10 is a partially sectional, schematic elevation of a conventional glow plug.

Referring to FIG. 9, the sixth embodiment will be described. A heater of this embodiment is a metal glow plug used for assisting start of a diesel engine or a water heater used for heating coolant of an engine or water of a heater core for heating, i.e., a so-called sheath heater having a metal sheath in which a heating element such as a heating coil is enclosed.

As shown in FIG. 9, a sheath heater 501 includes a metallic shell 503 made of carbon steel, a metal sheath 505 fitted in a front end portion of the metallic shell 503 and made of heat-resisting metal such as stainless steel, a heating coil (heat generating portion) 521 disposed concentrically within the metal sheath 505, and a terminal electrode 509 partially disposed within the metallic shell 503.

The metal sheath 505 has a semispherical, closed front end and a rear open end. Within the metal sheath 505 is closely packed a mass of insulating powder 517 having an electric insulating property thereby fixedly holding the heating coil 521.

On a rear end portion of the metal sheath 505 is fitted a front end portion of the metal shell 503, and the heating coil 521 is electrically connected at the rear end thereof to the terminal electrode 509 and at the front end thereof to the metal sheath 505.

The terminal electrode 509 is structured substantially similar to that of the first embodiment. Namely, the terminal electrode 509 has an inner pole member 327 and a terminal member 529 which are joined at the joining portions thereof by caulking.

This embodiment can produce substantially the same effect as the first embodiment, and coolant of a diesel engine can be heated by using the sheath heater 501 of this embodiment.

In the meantime, the sheath heater 501 of this embodiment can be used not only for heating coolant of a diesel engine but as a heat source for heating a small amount of water for a water heater, a washer of a toilet or a heater for hand washing. Further, the sheath heater 501 can be used as a glow plug.

From the foregoing, it will be understood that according to the present invention the terminal electrode of the heater can be connected to a power source by simply attaching the cap-shaped connector to the terminal electrode thereby allowing the connector to be lockingly engaged with the terminal electrode. Since the connector is adapted to be lockingly engaged in the locking engagement section of the terminal electrode, it is assuredly prevented from being removed or dropped off from the connector. When a number of such heaters are used (e.g., for a multi-cylinder engine), connectors can be attached separately or independently to the respective terminal electrodes. Thus, it becomes possible to take a signal out of each terminal electrode independently so that the performance of each heater such as a glow plug can be checked with ease. Namely, automatic check of the performance of each heater by using a microcomputer, i.e., a so-called on-board diagnosis can be attained.

Although the invention has been described above by reference to certain embodiments of the invention, the invention is not limited to the embodiments described above. Modifications and variations of the embodiment described above will occur to those skilled in the art, in light of the above teachings. For example, caulking can be, other than 4-point caulking, two-point caulking (portions to be driven are arranged at intervals of 180 degrees) as shown in FIG. 4A, 6-point caulking (portions to be driven are arranged at intervals of 60 degrees) as shown in FIG. 4C and 8-point caulking (portions to be driven are arranged at intervals of 45 degrees. In this connection, 4-point caulking, 6-point caulking and 8-point caulking are desirable since they can attain a terminal electrode that is resistant to impact and whose terminal members are hard to be separated from each other. In the meantime, the caulking can be done by using either of a tool having a pointed head or a flat head but a tool having a flat head is more desirable. The scope of the invention is defined with reference to the following claims.

What is claimed is:

1. A heater comprising:

a metallic shell;

a heating element having first and second lead wires disposed at a first end of the metallic shell, one of said first and second lead wires being electrically connected to the metallic shell; and a terminal electrode disposed at a second end of the metallic shell and electrically connected to the other of said first and second lead wires;

wherein the terminal electrode has a protruded portion protruded from the metallic shell, and the protruded portion of the terminal electrode has a mechanical engagement section lockingly engageable with a mechanical engagement section of a connector, and an electrical connecting section, which is separate from the mechanical engagement section, electrically connectable to an electrical connecting section of the connector.

2. A heater according to claim 1, wherein the locking engagement section comprises at least one of a depression and a projection of the terminal electrode.

3. A heater according to claim 1, wherein the locking engagement section comprises a depressed circumferential portion of the terminal electrode.

4. A heater according to claim 3, wherein the locking engagement section further comprises a pair of first and second flanges between which the depressed circumferential portion is disposed.

5. A heater according to claim 2, wherein the terminal electrode is rod-shaped and comprises an inner pole member and a terminal member which are arranged coaxially and joined together.

6. A heater according to claim 5, wherein the inner pole member and the terminal member have joining portions one of which is hollow so that the other of the joining portions is fitted in said one of the joining portions, and the locking engagement section is formed on an outer circumferential periphery of said one of the joining portions.

7. A heater according to claim 6, wherein the joining portions are caulked.

8. A heater according to claim 7, wherein caulking of the joining portions is one of 2-point caulking, 4-point caulking, 6-point caulking and 8-point caulking.

9. A heater according to claim 7, wherein said one of the joining portions is formed with a depression in which the other of the joining portions is fitted, and the depression has an extra depth for adjustment of a position of said one of the joining portions with the respect to the other of the joining portions.

10. A heater according to claim 7, wherein at least one of the joining portions has a knurled joining surface.

11. A heater according to claim 7, wherein at least one of the joining portions has a threaded joining surface.

12. A heater according to claim 7, wherein the joining portions have threaded joining surfaces and are threadedly engaged with each other.

13. A heater according to claim 7, wherein the joining portions have joining surfaces to which a conductive adhesive is applied.

14. A heater according to claim 21, wherein the terminal electrode is a single piece.

15. A ceramic heater comprising the heater according to claim 1.

16. A sheath heater comprising the heater according to claim 1.

17. A heater and connector assembly comprising:

a heater having a metallic shell, a heating element having first and second lead wires disposed at a front end of the metallic shell, one of said first and second lead wires being electrically connected to the metallic shell, and a terminal electrode partially disposed within the metallic shell and electrically connected to the other of said first and second lead wires, the terminal electrode having a protruded portion protruding from the metallic shell, the protruded portion of the terminal electrode having a locking engagement section; and a connector for electrically connecting the terminal electrode to an outside for conduction of the heating element, the connector being hollow and having a locking engagement section that is lockingly engaged with the locking engagement section of the terminal electrode thereby preventing axial movement of the connector relative to the terminal electrode.

18. A method of producing a heater having a metallic shell, a heating element having first and second lead wires, one of said first and second lead wires being electrically connected to the metallic shell, and a rod-shaped terminal electrode to be connected by a connector for electrically connecting the other of said first and second lead wires the heating element to an outside for conduction of the heating element, the method comprising:

preparing an inner pole member and a terminal member which have joining portions one of which is hollow so that the other of the joining portions can be fitted in said one of the joining portions;

fitting the other of the joining portions in said one of the joining portions;

caulking the joining portions thereby joining the inner pole member and the terminal member together to constitute the terminal electrode;

disposing the terminal electrode in the metallic shell.

19. A method according to claim 18, wherein at least one of the joining portions has a knurled joining surface.

20. A method according to claim 18, wherein at least one of the joining portions has a threaded joining surface.

21. A heater and connector assembly comprising:

a heater including a metallic shell;

a heating element having first and second lead wires disposed at a first end of the metallic shell, one of said first and second lead wires being electrically connected to the metallic shell, and a terminal electrode disposed at a second end of the metallic shell and electrically connected to the other of said first and second lead wires;

wherein the terminal electrode has a protruded portion protruded from the metallic shell, and the protruded portion of the terminal electrode has a mechanical engagement section and an electrical connecting section; and a connector including a mechanical engagement section lockingly engaged with the mechanical engagement section of the terminal electrode; and an electrical connecting section, which is separate from the mechanical engaging section, electrically connected to the electrical connecting section of the terminal electrode.

22. The heater and connector assembly according to claim 21, wherein the connector has a cap-like shape and the terminal electrode is partially inserted into the connector.

23. The heater and connector assembly according to claim 22, wherein the mechanical engagement section of the terminal electrode comprises a depression, and the mechanical engagement section of the connector has a projection corresponding to the depression of the mechanical engagement section of the terminal electrode.

24. The heater and connector assembly as claimed in claim 21, wherein said connector assembly makes electrical contact with the terminal electrode of only a single heater, thereby allowing for conduction of the heater independent of any other heaters.

* * * * *